US009404659B2

(12) United States Patent
Melton et al.

(10) Patent No.: US 9,404,659 B2
(45) Date of Patent: Aug. 2, 2016

(54) SYSTEMS AND METHODS FOR LATE LEAN INJECTION PREMIXING

(71) Applicant: General Electric Company, Schenectady, NY (US)

(72) Inventors: Patrick Benedict Melton, Greenville, SC (US); John Vanselow, Greenville, SC (US); Russell DeForest, Greenville, SC (US); Lucas Stoia, Greenville, SC (US)

(73) Assignee: General Electric Company, Schenectady, NY (US)

( * ) Notice: Subject to any disclaimer, the term of this patent is extended or adjusted under 35 U.S.C. 154(b) by 727 days.

(21) Appl. No.: 13/716,821

(22) Filed: Dec. 17, 2012

(65) Prior Publication Data

US 2014/0165577 A1 Jun. 19, 2014

(51) Int. Cl.

| | |
|---|---|
| ***F23R 3/06*** | (2006.01) |
| ***F23R 3/34*** | (2006.01) |
| ***F23R 3/36*** | (2006.01) |
| ***F23R 3/28*** | (2006.01) |

(52) U.S. Cl.

CPC ... *F23R 3/36* (2013.01); *F23R 3/06* (2013.01); *F23R 3/286* (2013.01); *F23R 3/34* (2013.01); *F23R 3/346* (2013.01)

(58) Field of Classification Search

CPC ..... F23R 3/34; F23R 3/36; F23R 3/286

See application file for complete search history.

(56) References Cited

U.S. PATENT DOCUMENTS

| | | | | |
|---|---|---|---|---|
| 4,581,581 | A | 4/1986 | Pelc | |
| 4,843,884 | A | 7/1989 | House et al. | |
| 5,257,629 | A | 11/1993 | Kitney et al. | |
| 5,309,914 | A | 5/1994 | Iinuma | |
| 5,412,763 | A | 5/1995 | Knoplioch et al. | |
| 5,450,725 | A * | 9/1995 | Takahara | F23R 3/286 60/737 |
| 5,544,655 | A | 8/1996 | Daigle | |

(Continued)

FOREIGN PATENT DOCUMENTS

| | | | |
|---|---|---|---|
| EP | 1180646 | A1 | 2/2002 |
| EP | 2211150 | A1 | 7/2010 |

(Continued)

OTHER PUBLICATIONS

European Search Report and Written Opinion from EP Application No. 13196758.0 dated Jul. 18, 2014.

(Continued)

*Primary Examiner* — Phutthiwat Wongwian
*Assistant Examiner* — William Breazeal
(74) *Attorney, Agent, or Firm* — Sutherland Asbill & Brennan LLP

(57) ABSTRACT

A late lean injection combustor assembly may include a first interior in which a first fuel supplied thereto is combustible, a flow sleeve annulus including a second interior in which a second fuel supplied thereto is combustible, at least one fuel injector disposed about the second interior, and at least one elongate premixing conduit disposed about the flow sleeve annulus and in fluid communication with the at least one fuel injector. The at least one elongate premixing conduit may be in fluid communication with a compressor discharge air and the second fuel such that the compressor discharge air and the second fuel are premixed within the elongate premixing conduit before entering the second interior by way of the at least one fuel injector.

11 Claims, 3 Drawing Sheets

(56) References Cited

U.S. PATENT DOCUMENTS

| | | | | |
|---|---|---|---|---|
| 5,628,192 | A * | 5/1997 | Hayes-Bradley et al. | 60/733 |
| 5,647,215 | A | 7/1997 | Sharifi et al. | |
| 5,718,228 | A | 2/1998 | Hiruta et al. | |
| 5,991,239 | A | 11/1999 | Fatemi-Booshehri et al. | |
| 6,171,247 | B1 | 1/2001 | Seward et al. | |
| 6,556,695 | B1 | 4/2003 | Packer et al. | |
| 6,732,527 | B2 * | 5/2004 | Freeman et al. | 60/737 |
| 7,324,910 | B2 | 1/2008 | Struempler et al. | |
| 7,542,544 | B2 | 6/2009 | Rubin et al. | |
| 8,547,097 | B2 | 10/2013 | Gebhardt et al. | |
| 2001/0049932 | A1 | 12/2001 | Beebe | |
| 2002/0020173 | A1 * | 2/2002 | Varney | 60/737 |
| 2004/0087854 | A1 | 5/2004 | Ueda | |
| 2005/0075565 | A1 | 4/2005 | Satoh | |
| 2005/0119575 | A1 | 6/2005 | Ladabaum et al. | |
| 2007/0239020 | A1 | 10/2007 | Iinuma et al. | |
| 2008/0133200 | A1 | 6/2008 | Owens et al. | |
| 2008/0180580 | A1 | 7/2008 | Kadrmas | |
| 2008/0276695 | A1 | 11/2008 | Prater et al. | |
| 2009/0048789 | A1 | 2/2009 | Yu et al. | |
| 2010/0170216 | A1 | 7/2010 | Venkataraman et al. | |
| 2010/0199770 | A1 | 8/2010 | Kleinert | |
| 2010/0215238 | A1 | 8/2010 | Lu et al. | |
| 2010/0310145 | A1 | 12/2010 | Hashimoto et al. | |
| 2011/0016977 | A1 | 1/2011 | Guracar | |
| 2011/0016978 | A1 | 1/2011 | Kleinert et al. | |
| 2011/0016979 | A1 | 1/2011 | Oberdorfer et al. | |

FOREIGN PATENT DOCUMENTS

| | | | |
|---|---|---|---|
| JP | 2009281731 | A1 | 12/2009 |
| WO | 2005009244 | A1 | 2/2005 |

OTHER PUBLICATIONS

Tomikava et al., "Nondestructive Inspection of a Wooden Pole Using Ultrasonic Computed Tomography", Transactions on Ultrasonics IEEE, Ferroelectrics and Frequency Control, vol. No. 33, Issue No. 4, Jul. 1986.

Liang et al., "Continuous Wave Ultrasonic Tomography", Transactions on Ultrasonics IEEE, Ferroelectrics and Frequency Control, vol. No. 48, Issue No. 1, pp. 285, Jan. 2001.

Fenster, "3-Diamond Ultrasound Imaging", http://www.axisimaginfgnews.com/2004/12/3-dimensional-ultrsound-imaging/, Aug. 12, 2004.

Waters et al., "Tomographic Imaging of an Ultrasonic Field in a Plane by Use of a Linear Array: Theory and Experiment", Transactions on Ultrasonics IEEE, Ferroelectrics and Frequency Control, vol. No. 52, Issue No. 11, pp. 2065, Nov. 2005.

Fuchs et al., "Multi-Modality Approaches for Complex Test Requirements", International Symposium on NDT in Aerospace, Dec. 3-5, 2008.

"Tomography", Pile Test, http://www.piletest.com/show.asp?page=tomography, pp. 1-5, Dec. 28, 2008.

Bulavinov et al., "Industrial Application of Real-Time 3D Imaging by Sampling Phased Array", 10th European Conference on Non-Destructive Testing, 2010.

"Seeing With Sound—An Introduction to Ultrasound", Union College, Jan. 10, 2010.

XIANGet al., "High Resolution Photoacoustic Standard CT for Quasi-3d Breast Cancer Imaging", Symposium on Photonics and Optoelectronic, pp. 1, Jun. 19-21, 2010.

Greensted, "Delay Sum Beamforming", http://www.labbookpages.co.uk/audio/beamforming/delay/Sum.html, Sep. 3, 2011.

European Search Report and Opinion issued in connection with corresponding EP Application No. 12187664 on Mar. 18, 2014.

* cited by examiner

SYSTEMS AND METHODS FOR LATE LEAN INJECTION PREMIXING

FIELD OF THE DISCLOSURE

Embodiments of the present application relate generally to gas turbine engines and more particularly to combustor assemblies including late lean injection (LLI) premixing.

BACKGROUND OF THE DISCLOSURE

In gas turbine engines, mixtures of fuel and gas are combusted within a combustor disposed upstream from a transition piece and a turbine. The combustor produces high energy fluids from which mechanical energy can be derived for the generation of power and electricity. The high energy fluids are continually reused until significant levels of power generation cannot be derived at which point they are exhausted into the atmosphere. This exhaust often includes pollutants produced during the combustion, such as nitrous oxides (NOx) and carbon monoxide (CO).

Efforts have been expended to reduce the amount of pollutants produced by the combustion processes and include the development of LLI. LLI involves the injection of combustible materials into the flow of the high energy fluids at a location downstream from the normal combustion zone in the combustor. This downstream location could be defined as a section of the combustor liner or at a section of the transition piece. In any case, the combustible materials injected at this location increase the temperature and energy of the high energy fluids and lead to an increased consumption of CO with little to no significant increase in NOx for reasonable levels of LLI fuel flow.

BRIEF DESCRIPTION OF THE DISCLOSURE

Some or all of the above needs and/or problems may be addressed by certain embodiments of the present application. According to one embodiment, there is disclosed a LLI combustor assembly. The LLI combustor assembly may include a first interior in which a first fuel supplied thereto is combustible. The LLI combustor assembly may also include a flow sleeve annulus including a second interior in which a second fuel supplied thereto is combustible. The flow sleeve annulus may fluidly couple the first interior and the second interior. The LLI combustor assembly may also include at least one fuel injector disposed about the second interior. The at least one fuel injector may be configured to supply the second fuel to the second interior. The LLI combustor assembly may also include at least one elongate premixing conduit disposed about the flow sleeve annulus and in fluid communication with the at least one fuel injector. In this manner, the at least one elongate premixing conduit may be in fluid communication with a compressor discharge air and the second fuel such that the compressor discharge air and the second fuel are premixed within the elongate premixing conduit before entering the second interior by way of the at least one fuel injector.

According to another embodiment, there is disclosed a gas turbine engine assembly. The gas turbine engine assembly may include a combustor having a first interior in which a first fuel supplied thereto is combustible. The gas turbine engine assembly may also include a turbine that receives the products of at least the combustion of the first fuel. The gas turbine engine assembly may also include a flow sleeve annulus including a second interior in which a second fuel supplied thereto and the products of the combustion of the first fuel are combustible. The flow sleeve annulus may fluidly couple the combustor and the turbine. The gas turbine engine assembly may also include at least one fuel injector disposed about the second interior and configured to supply the second fuel to the second interior. The gas turbine engine assembly may also include at least one elongate premixing conduit disposed about the flow sleeve annulus and in fluid communication with the at least one fuel injector. In this manner, the at least one elongate premixing conduit may be in fluid communication with a compressor discharge air and the second fuel such that the compressor discharge air and the second fuel are premixed within the elongate premixing conduit before entering the second interior by way of the at least one fuel injector.

Further, according to another embodiment, there is disclosed a method for facilitating LLI. The method may include providing a first fuel to a first interior of a combustor. The method may also include providing a second fuel to at least one elongate premixing conduit disposed about a flow sleeve annulus. The method may also include providing compressor discharge air to the at least one elongate premixing conduit. The method may also include premixing the second fuel with the compressor discharge air within the at least one elongate premixing conduit. The method may also include injecting the premixed second fuel/compressor discharge air into a second interior of the combustor with at least one fuel injector.

Other embodiments, aspects, and features of the invention will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale, and wherein.

DETAILED DESCRIPTION OF THE DISCLOSURE

Illustrative embodiments will now be described more fully hereinafter with reference to the accompanying drawings, in which some, but not all embodiments are shown. The present application may be embodied in many different forms and should not be construed as limited to the embodiments set forth herein. Like numbers refer to like elements throughout.

Figure 1:
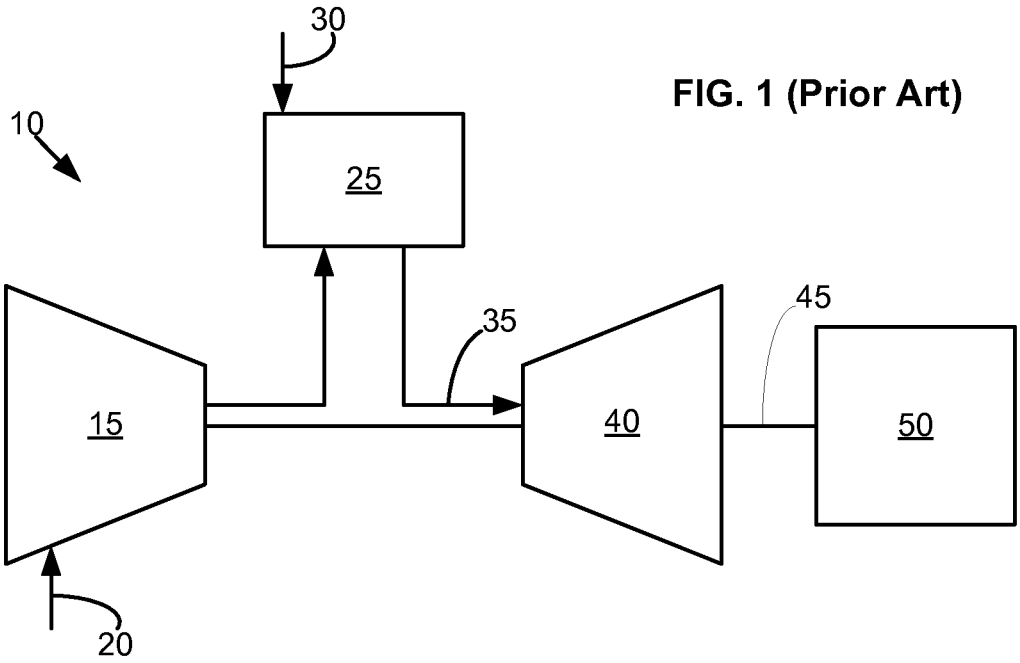
FIG. 1 (Prior Art)
FIG. 1 is a schematic of an example diagram of a gas turbine engine with a compressor, a combustor, and a turbine.

Illustrative embodiments are directed to, among other things, a combustor assembly including LLI premixing. FIG. 1 shows a schematic view of a gas turbine engine 10 as may be used herein. As is known, the gas turbine engine 10 may include a compressor 15. The compressor 15 may compress an incoming flow of air 20. The compressor 15 may deliver the compressed flow of air 20 to a combustor 25. The combustor 25 may mix the compressed flow of air 20 with a pressurized flow of fuel 30 and ignite the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 may drive the turbine 40 so as to produce mechanical work. The mechanical work produced in the turbine 40 may drive the compressor 15 via a shaft 45 and an external load 50 such as an electrical generator or the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components.

Other types of gas turbine engines may also be used herein. Moreover, multiple gas turbine engines, other types of turbines, and other types of power generation equipment may be used herein together.

Figure 2:
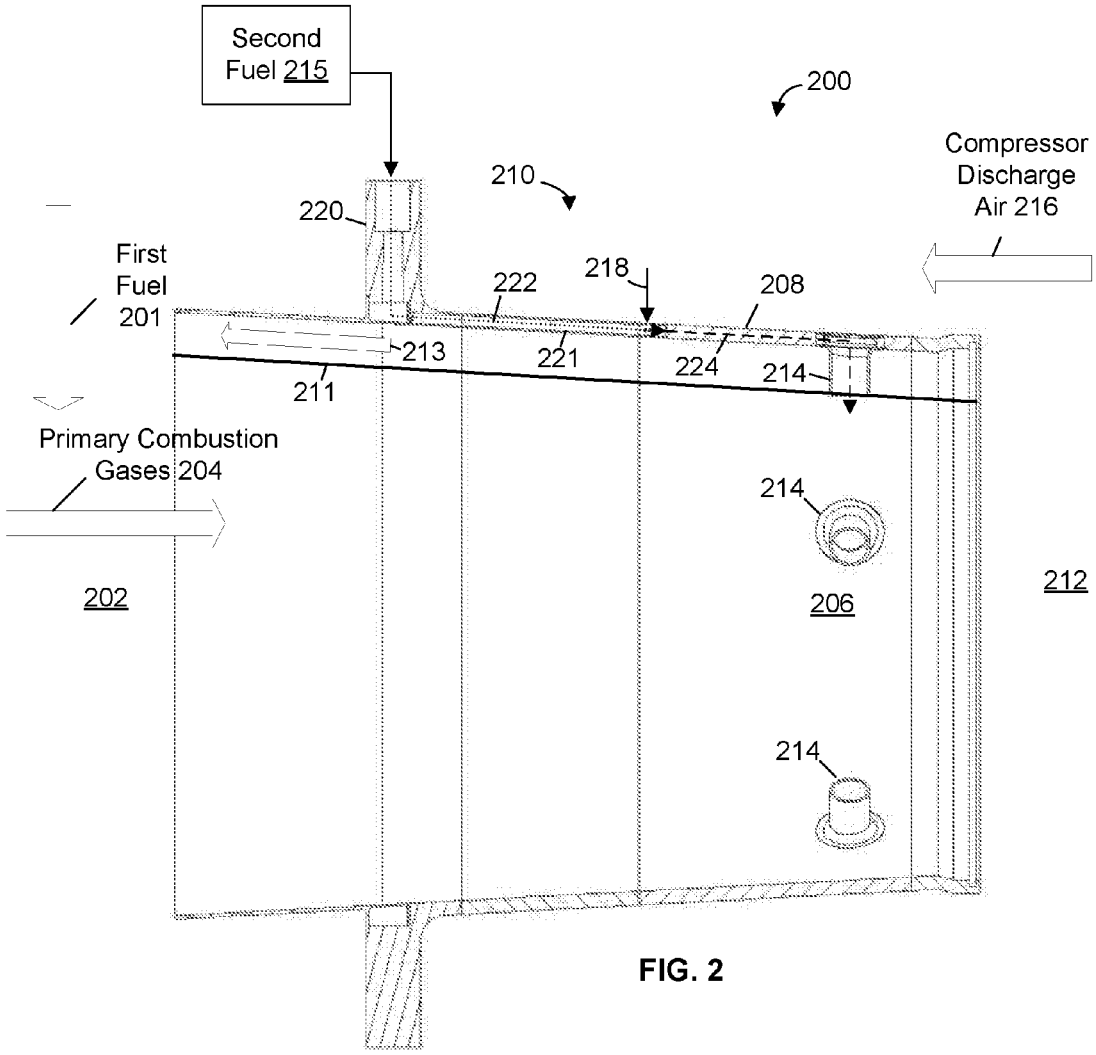
FIG. 2 is a cross-sectional view of a portion of a combustor assembly, according to an embodiment.

FIG. 2 depicts an embodiment of a LLI combustor assembly 200 of the present application for facilitating LLI premixing. The LLI combustor assembly 200 may include a first interior 202 in which a first fuel 201 supplied thereto is combustible. For example, the first interior 202 may be a primary combustion zone of a combustor. In this manner, the first fuel 201 may be a primary fuel that is injected into the primary combustion zone. In some instances, the primary fuel may be premixed with a compressor discharge air before, during, or after being injected into the primary combustion zone. For example, one or more premixing nozzles may inject the first fuel 201, having been premixed, into the first interior 202. In other instances, the first fuel 201 may be injected directly into the first interior 202. Accordingly, the first interior 202 may include a flow of primary combustion gases 204 from the primary combustion zone. The first interior 202 and the associated combustor components for creating the primary combustion gasses 204 are not illustrated in detail. That is, any number of combustor or nozzle arrangements may be used to provide the primary combustion gases 204.

Still referring to FIG. 2, in an embodiment, a flow sleeve annulus 210 may connect the first interior 202 with a transition piece 212. The transition piece 212 may direct the contents of the combustor assembly 200 to a turbine (not shown). In some instances, the flow sleeve annulus 210 may include a liner 211 forming a passageway for a cooling flow 213. The cooling flow may include, among other things, compressor discharge air 216. The flow sleeve annulus 210 may include a second interior 206 in which a second fuel 215 (having been mixed with air) may be supplied. For example, in certain embodiments, the second fuel 215 may be supplied to the second interior 206 via a fuel manifold 220 and associated fuel conduit 221 disposed about the flow sleeve annulus 210. The first fuel and the second fuel may initiate from the same source or different sources. Moreover, the first fuel and the second fuel may be the same, dissimilar, or any combination thereof. Indeed, the first fuel and the second fuel may be any fuel.

In one embodiment, one or more fuel injectors 214 may be structurally supported by the flow sleeve annulus 210. The fuel injectors 214 may be disposed about the second interior 202 and may be configured to supply the second fuel 215 (having been mixed with air) to the second interior 206. The fuel injectors 214 may be disposed about the second interior 206 in any one of a single axial stage, multiple axial stages, a single axial circumferential stage, multiple axial circumferential stages, or the like. In this manner, the fuel injectors 214 may supply the second fuel 215 to the second interior 206 in a direction that is substantially traverse to a predominant flow of the flow sleeve annulus 210. Any number, type, or arrangement of fuel injector nozzles 214 may be used.

In certain aspects, at least one elongate premixing conduit 208 may be disposed about the flow sleeve annulus 210. The elongate premixing conduit 208 may include any passageway, channel, slot, duct, or the like that facilitates the mixing of fuel and air. For example, in some instances, the elongate premixing conduit 208 may be formed between an inner and outer wall of the flow sleeve annulus 210 and may extend wholly or partially along the axial length of the flow sleeve annulus 210.

In an embodiment, the elongate premixing conduit 208 may be in fluid communication with the fuel injectors 214, a compressor discharge air 216, and the second fuel 215. In this manner, the compressor discharge air 216 and the second fuel 215 may be premixed within the elongate premixing conduit 208 before entering the second interior 206 by way of the fuel injectors 214. For example, the fuel manifold 220 may be in fluid communication with the elongate premixing conduit 208 via the fuel conduit 221 for supplying the second fuel 215 to the elongate premixing conduit 208, as denoted by the dotted line 222. Compressor discharge air 216 may enter the elongate premixing conduit 208 at inlet 218 such that the second fuel 215 and the compressor discharge air 216 may be premixed within the elongate premixing conduit 208 thereby forming an air/fuel mixture as denoted by dashed line 224. Accordingly, in this embodiment, a portion of the axial length of the flow sleeve annulus 210 may be utilized to premix the second fuel 215 with the compressor discharge air 216. The premixed air/fuel mixture may then be directed into the second interior 206 by the fuel injector nozzles 214.

The second fuel 215 and the compressor discharge air 216 may be supplied to the elongate premixing conduit 208 by any number of circuit arrangements. For example, the LLI combustor assembly 200 may include one or more fuel conduits 221 (or feeds) in fluid communication with the elongate premixing conduit 208 and/or one or more compressor discharge air inlets 218 (or feeds) in fluid communication with the elongate premixing conduit 208. In this manner, any number or combination of conduits or passageways may be used to supply the fuel 215 and/or air 216 to the elongate premixing conduits 208. Moreover, any number or combination of elongate premixing conduits 208 may be used.

The transition piece 212 may also include a similar configuration for facilitating LLI premixing. That is, the transition piece may include any number or combination of fuel manifolds, fuel conduits, air inlets, elongate premixing conduits, fuel injectors, or the like disposed about the transition piece 212 in a similar fashion to the flow sleeve annulus 210 described above.

Figure 3:
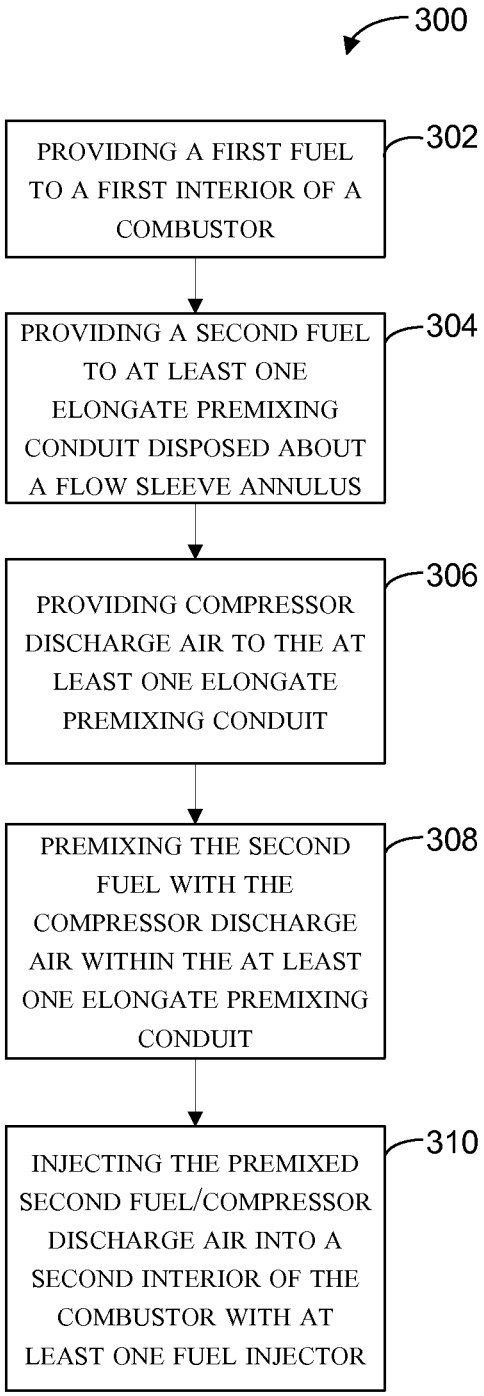
FIG. 3 is an example flow diagram of a method, according to an embodiment.

FIG. 3 illustrates an example flow diagram of a method 300 for facilitating late lean injection. In this particular embodiment, the method 300 may begin at block 302 of FIG. 3 in which the method 300 may include providing a first fuel to a first interior of a combustor. For example, the first interior may be a primary combustion zone of a combustor. At block 304, the method 300 may include providing a second fuel to at least one elongate premixing conduit disposed about a flow sleeve annulus. For example, the second fuel may be supplied to the elongate premixing conduit via a fuel manifold and associated fuel conduit disposed about the flow sleeve annulus. At block 306, the method 300 may include providing compressor discharge air to the at least one elongate premixing conduit. The compressor discharge air may be provided to the elongate premixing conduit via any number of openings or slots about the elongate premixing conduit. For example, the compressor discharge air may be provided before and/or after the second fuel enters the elongate premixing conduit. At block 308, the method 300 may include premixing the second fuel with the compressor discharge air within the at least one elongate premixing conduit. In this manner, the second fuel and the compressor discharge air may be mixed along the axial length of all or part of the flow sleeve annulus.

At block 310, the method 300 may include injecting the premixed second fuel/compressor discharge air into a second interior of the combustor with at least one fuel injector.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A late lean injection combustor assembly including a first fuel, a second fuel, and compressor discharge air, the late lean injection combustor assembly comprising:

a flow sleeve annulus comprising an inner liner and an outer wall, the outer wall having a radially outer surface and a radially inner surface, the inner liner being radially within the outer wall, the outer wall circumscribing the inner liner, and the inner liner defining a first interior in which the first fuel is supplied;

a fluid flow path radially between the radially inner surface and a radially outer surface of the inner liner, the fluid flow path configured to flow fluid axially along the inner liner;

at least one elongate premixing conduit comprising a straight channel formed between the radially outer surface of the outer wall and the radially inner surface and extending along an axial length of the outer wall;

wherein the second fuel supplied to a second interior that is disposed within the inner liner, the flow sleeve annulus fluidly coupling the first interior and the second interior;

at least one fuel injector disposed about the second interior, the at least one fuel injector configured to supply the second fuel to the second interior;

the at least one elongate premixing conduit in fluid communication with the at least one fuel injector; and the at least one elongate premixing conduit being in fluid communication with the compressor discharge air and the second fuel such that the compressor discharge air and the second fuel are premixed within the elongate premixing conduit before entering the second interior by way of the at least one fuel injector.

2. The late lean injection combustor assembly of claim 1, further comprising a fuel manifold disposed about the flow sleeve annulus, the fuel manifold being in fluid communication with the at least one elongate premixing conduit for supplying the second fuel thereto.

3. The late lean injection combustor assembly of claim 1, wherein the second fuel is injected into the at least one elongate premixing conduit before the compressor discharge air.

4. The late lean injection combustor assembly of claim 1, wherein the second fuel is injected into the at least one elongate premixing conduit after the compressor discharge air.

5. The late lean injection combustor assembly of claim 1, wherein the at least one fuel injector supplies the second fuel to the second interior in a direction that is substantially traverse to a predominant flow of the flow sleeve annulus.

6. A gas turbine engine assembly, comprising:

the late lean injection combustor assembly according to claim 1;

the gas turbine engine assembly having a turbine that receives products of at least combustion of the first fuel; the flow sleeve annulus fluidly coupling the late lean injection combustor assembly and the turbine.

7. The gas turbine engine assembly of claim 6, further comprising a fuel manifold disposed about the flow sleeve annulus, the fuel manifold being in fluid communication with the at least one elongate premixing conduit for supplying the second fuel thereto.

8. The gas turbine engine assembly of claim 6, further comprising one or more compressor discharge air feeds in fluid communication with the at least one elongate premixing conduit.

9. The gas turbine engine assembly of claim 6, wherein the second fuel is injected into the at least one elongate premixing conduit before the compressor discharge air.

10. The gas turbine engine assembly of claim 6, wherein the second fuel is injected into the at least one elongate premixing conduit after the compressor discharge air.

11. The gas turbine engine assembly of claim 6, wherein the at least one fuel injector supplies the second fuel to the second interior in a direction that is substantially traverse to a predominant flow of the flow sleeve annulus.

* * * * *